US009566641B2

(12) United States Patent
McElroy

(10) Patent No.: US 9,566,641 B2
(45) Date of Patent: Feb. 14, 2017

(54) FORGING APPARATUS

(71) Applicant: ROLLS-ROYCE PLC, London (GB)

(72) Inventor: Graeme McElroy, Paisley (GB)

(73) Assignee: ROLLS-ROYCE PLC, London (GB)

( * ) Notice: Subject to any disclaimer, the term of this patent is extended or adjusted under 35 U.S.C. 154(b) by 0 days.

(21) Appl. No.: 14/937,109

(22) Filed: Nov. 10, 2015

(65) Prior Publication Data

US 2016/0158826 A1 Jun. 9, 2016

(30) Foreign Application Priority Data

Dec. 5, 2014 (GB) ..... 1421669.1

(51) Int. Cl.

| | |
|---|---|
| ***B21J 5/02*** | (2006.01) |
| ***B21K 3/00*** | (2006.01) |
| ***B21J 9/02*** | (2006.01) |
| ***B21K 3/04*** | (2006.01) |

(52) U.S. Cl.

CPC ..... *B21K 3/00* (2013.01); *B21J 5/025* (2013.01); *B21J 9/027* (2013.01); *B21K 3/04* (2013.01)

(58) Field of Classification Search

CPC ..... B21J 5/02; B21J 5/025; B21J 5/08; B21J 7/18; B21J 9/02; B21J 9/022

See application file for complete search history.

(56) References Cited

U.S. PATENT DOCUMENTS

2014/0165688 A1* 6/2014 McBain ..... B21J 5/025 72/352

FOREIGN PATENT DOCUMENTS

| | | | |
|---|---|---|---|
| CN | 103639336 | A | 3/2014 |
| FR | 2 975 030 | A1 | 11/2012 |
| JP | S61 129247 | A | 6/1986 |
| JP | H03-23026 | A | 1/1991 |
| WO | 2005/037459 | A1 | 4/2005 |

OTHER PUBLICATIONS

Apr. 22, 2016 Search Report issued in European Patent Application No. 15193781.

May 21, 2015 Search Report in Great Britain Patent Application No. 1421669.1.

* cited by examiner

*Primary Examiner* — Debra Sullivan

(74) *Attorney, Agent, or Firm* — Oliff PLC

(57) ABSTRACT

A forging apparatus and method is disclosed in which a die has two separate cavities, each having a first cavity portion and a second cavity portion. A billet of material is received in a first cavity portion and struck by a striking portion of an extrusion punch so as to be forced into the corresponding second cavity portion to form a shaped component. The billet of material can be placed into either of the two cavities for extrusion. This may increase the number of extrusion operations that can be performed by a single die.

15 Claims, 5 Drawing Sheets

FORGING APPARATUS

CROSS-REFERENCE TO RELATED APPLICATIONS

This application is based upon and claims the benefit of priority from British Patent Application Number 1421669.1 filed 5 Dec. 2014, the entire contents of which are incorporated by reference.

BACKGROUND

1. Field of the Disclosure

This disclosure relates to an apparatus and method for forging/extruding a shaped component, for example a shaped component of a gas turbine engine. At least part of the disclosure relates to a method and apparatus for use in automated forging/extruding of a shaped component.

2. Description of the Related Art

Forging is used in a variety of metalworking operations in order to produce shaped components. Typically, a hammer or ram is used to provide a compressive force to a billet of metal (which may be heated) in order to deform the metal into the shape of a die.

Various different types of forging process have been developed to suit the desired properties of the shaped component, for example in terms of size, shape, material properties and required throughput.

In one particular type of forging, which may be referred to as a horizontal split die forging press or as a multiforge, a billet of heated metal is positioned in a forging press, and then a ram is used to strike the billet so as to provide a, typically horizontal, force to press the metal billet into a die. In this way, the shape of the billet deforms so as to take on the shape of the die.

The die pieces in such arrangements experience very high loads during the forging process. This leads to wear of the dies and means that the die (which may include an upper die piece and/or a lower die piece) needs to be replaced once the wear has reached an unacceptable level. Typically, these upper and/or lower die pieces wear more quickly (and thus may require more frequent replacement) than other parts of the apparatus used in the forging process, or indeed in the entire manufacturing process used to produce a component, of which the forging process may be only a part.

The process of changing a die may take a significant amount of time, for example between 2 and 6 hours. During this period, the forging apparatus cannot be used, and so no components can be manufactured.

The dies themselves may be expensive to manufacture. For example, the dies may require relatively expensive heat treatment, such as nitriding, due to the high loads that they experience during use. Expensive tooling, such as carbide tooling, may be required to machine the dies.

Changing dies may result in slight differences in the manufactured components, for example due to manufacturing tolerances of the dies and/or set-up differences.

OBJECTS AND SUMMARY

According to an aspect, there is provided a forging apparatus comprising a die for receiving a billet; and an extrusion punch for striking the billet when the billet is in the die. The die comprises an upper die and a lower die that together form two cavities; and each cavity comprises a first cavity portion in which the billet is received and a second cavity portion into which the billet is deformed when it is struck by the extrusion punch.

According to an aspect, there is provided a method of extruding a billet into a formed shape. The method comprises placing the billet into one of two cavities of a die, each cavity comprising a first cavity portion into which the billet is placed and a second cavity portion. The method comprises striking the billet with an extrusion punch so as to push and deform the billet from the first cavity portion into the respective second cavity portion.

Aspects of the present disclosure may allow billets to be extruded using at least two cavities of a die. This may allow more billets to be extruded (for example into finished or part-finished parts) using the same die. For example, if a die is provided with two cavities, then it may be possible to process twice as many billets using that die than using a die provided with just one cavity. The number of extrusion operations that can be performed by a single die may be increased compared with conventional dies.

The apparatus and/or method disclosed and/or claimed herein may result in fewer changes of die for a given number of extrusions. The apparatus and/or method disclosed and/or claimed herein may reduce the overall time spent changing dies, for example because the die may require less frequent changing. The apparatus and/or method disclosed and/or claimed herein may reduce the total die cost, for example the by reducing the number of dies that need to be produced and/or replaced to process a given number of billets. The total cost and/or time of tooling (such as carbide tooling, for example) required to produce the dies (for example the cost per processed billet) and/or the total cost and/or time of producing the dies (each of which may require machining and/or nitriding) themselves (for example the cost per processed billet) may be reduced.

The apparatus and/or method disclosed and/or claimed herein may be part of an automated process, for example using a reciprocating extrusion punch or a reciprocating ram to strike the extrusion punch, and an automated machine for positioning the billet and removing the shaped part from the die.

The first cavity portion and the second cavity portion of each cavity may be offset from each other in a direction that is aligned with a forging direction. The striking force provided by the extrusion punch in a given forging operation may be collinear with the offset from the first cavity portion to the second cavity portion.

The die may be part of, or provided to, upper and lower presses (which may be referred to as first and second presses). For example, the die may comprise an upper die part that may be part of, or provided to, an upper press and a lower die part that may be part of, or provided to, a lower press. In such an arrangement, the upper die part and the lower die part may form the cavities when brought together.

The first cavity portion and the second cavity portion may be said to be fluidly linked, for example in fluid communication. A linking portion may (or may not) be provided between the first cavity portion and the second cavity portion. The material of the billet may be moveable (for example by flowing) from the first cavity portion to the second cavity portion. The material of the billet may move from the first cavity portion to the second cavity portion when it is struck by the extrusion punch.

Each of the two (or more) cavities may be identical. Accordingly, the first cavity portion of one cavity may be identical to that of the other cavity. The second cavity portion of one cavity may be identical to that of the other cavity.

The two cavity portions may be different. This may allow different parts to be formed (or extruded) using a single die, for example different types of aerofoil components.

The extrusion punch may comprise a body portion and a striking portion. Each of the body portion and the striking portion may have a longitudinal axis. The striking portion being received by (for example at least partially received by) a first cavity portion in order to strike the billet. The longitudinal axis of the striking portion may be parallel to and offset from the longitudinal axis of the body portion. The longitudinal axis of a portion may be a centreline of the respective portion. The longitudinal axes may be parallel to the direction of movement of the extrusion punch during the extrusion operation.

The longitudinal axis of the striking portion may be positioned relative to the longitudinal axis of the body portion such that rotation of the extrusion punch about the longitudinal axis of the body portion by a predetermined angle results in the striking portion moving from a position in which it can be received by the first cavity portion of one cavity to a position in which it can be received by the first cavity portion of another cavity.

The striking portion may not overlap with the centreline of the body portion. The centreline of the body portion (including an extension of the centreline beyond the body portion itself) may be said not to pass through any part of the striking portion. The distance (for example perpendicular distance and/or closest distance) between the centreline of the body portion and the centreline of the striking portion may be greater than half of the overall width of the striking portion. For example, where the striking portion has a circular cross-section, the distance (for example perpendicular distance and/or closest distance) between the centreline of the body portion and the centreline of the striking portion may be greater than the radius of the of the cross-section of the striking portion.

The extrusion punch may comprise a body portion and two (for example at least two) striking portions. In such an arrangement, each of the body portion and the two striking portions may have a longitudinal axis. The longitudinal axes of the striking portions may be parallel to and offset from the longitudinal axis of the body portion. One of the striking portions may be positioned to be received by the first cavity portion of a first cavity in order to strike a billet and the other of the striking portions being positioned to be received by the first cavity portion of a second cavity in order to strike a billet. According to such an arrangement, it may be possible to strike two billets with the extrusion punch simultaneously. Each extrusion step may comprise extruding two billets simultaneously.

The forging apparatus may comprise a ram arranged to strike the extrusion punch. The ram may cause the extrusion punch to strike the billet. The extrusion punch may be supported in a holder prior to being struck by the ram. This may help to ensure that the extrusion punch strikes the billet accurately and repeatably and/or may provide good tolerance to misalignment between the ram and the billet during forging.

There is provided a method of extruding multiple billets into formed shapes. The method comprises extruding a first subset of the billets using the method and/or apparatus described and/or claimed herein and a first one of the cavities for each extrusion, the extrusion punch comprising a body portion and a striking portion, the striking portion being used to strike each of the billets. The method may comprise moving the extrusion punch so as to move the striking portion to be aligned with second cavity rather than the first cavity. The method may comprise extruding a second subset of the billets using the method and/or apparatus described and/or claimed herein and the second cavity for each extrusion.

As noted elsewhere herein, each of the body portion and the striking portion of the extrusion punch may have a longitudinal axis. Also as noted elsewhere herein, the longitudinal axis of the striking portion may be parallel to and offset from the longitudinal axis of the body portion. In such an arrangement, the step of moving the extrusion punch may comprise rotating the extrusion punch about the longitudinal axis of the body portion. This rotation may cause the striking portion to move from being aligned with the first cavity portion of the first cavity to the first cavity portion of the second cavity.

Such a rotation of the extrusion punch about the longitudinal axis may be through any suitable angle, for example through 180 degrees.

The extrusion punch may be moved such that the striking portion is moved from being aligned with the first cavity to being aligned with the second cavity when the first cavity is deemed to be worn sufficiently that the formed shapes would not be within design tolerance. Such movement may be performed, for example, just before the formed shapes would not be within design tolerance, or just after the formed parts are not within design tolerance (for example after detection of the first formed part that is not within design tolerance). The point at which the extrusion punch is moved may be determined in any suitable manner, for example by monitoring the wear of the cavity itself and/or by monitoring the formed shapes produced by the extruding process, for example dimensions and/or shapes of the formed shapes. Additionally or alternatively, the movement may be performed after a predetermined number of extrusions have been performed using the first cavity. Such a predetermined number may be based on knowledge of the wear rate of a die.

The die may comprise an upper die and a lower die. The upper die and the lower die may be moved together in order to form the first and second cavities. The direction in which the upper die and the lower die are moved together may be said to be a clamping direction. Such a clamping direction may be perpendicular to the extrusion direction, i.e. perpendicular to the direction in which the extrusion punch strikes the billet in operation.

The forging apparatus, forging method and/or die described and/or claimed herein may be used in the manufacture of any suitable shape, such as an aerofoil, which may be, for example, for a gas turbine engine. Thus, the second cavity portions of the forging apparatus may define an aerofoil shape (or any other desired shape). Further processing, such as finishing and/or machining, may be required before the final shape (for example a final aerofoil shape) is defined.

According to an aspect, there is provided a shaped component and/or a part manufactured at least in part using the forging apparatus and/or die and/or methods as described and/or claimed above and elsewhere herein.

BRIEF DESCRIPTION OF THE DRAWINGS

For a better understanding of the present disclosure, reference will now be made, by way of non-limitative example only, to the accompanying drawings, in which.

DETAILED DESCRIPTION OF EMBODIMENTS

Figure 1:
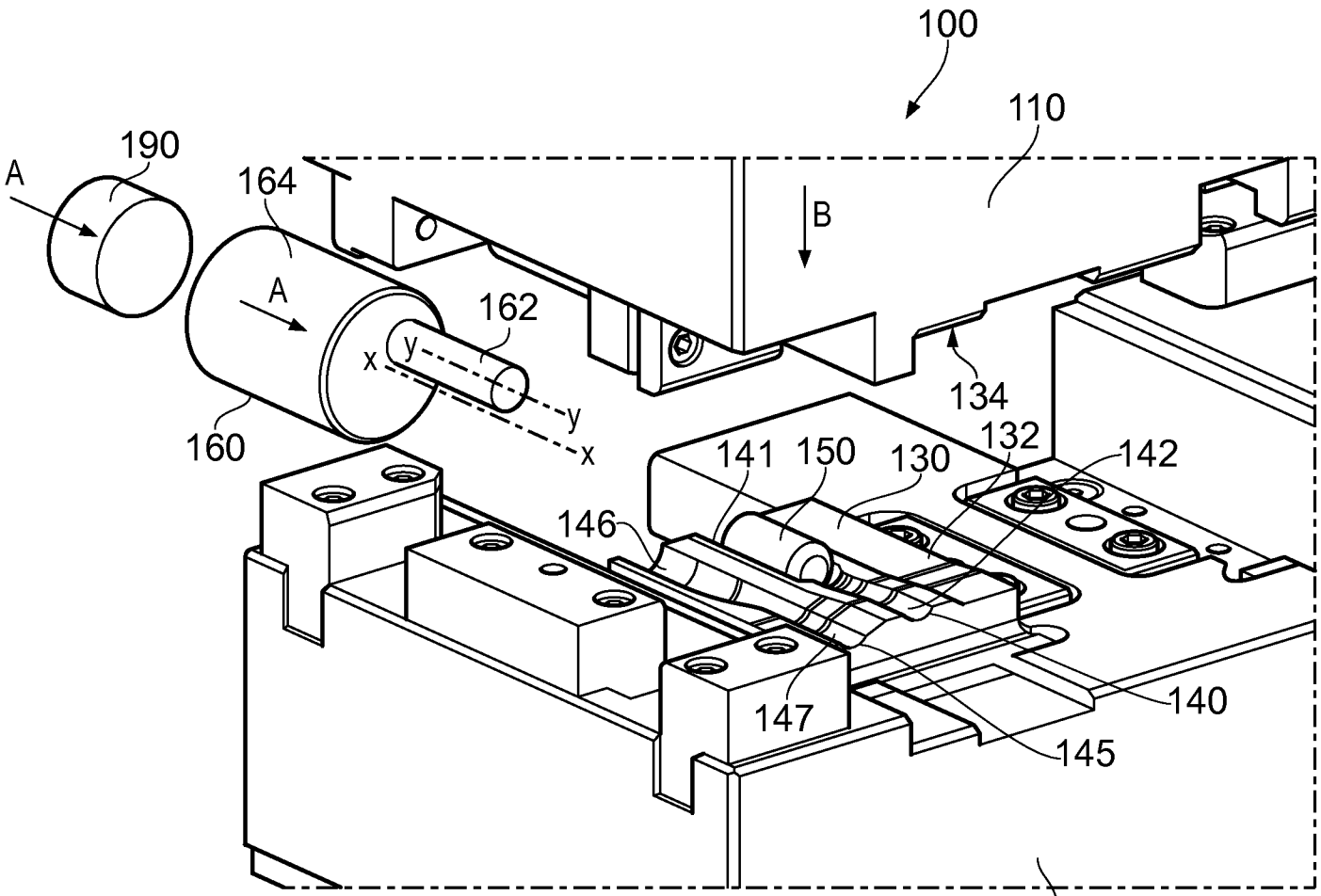
FIG. 1 shows a perspective view of a forging apparatus according to the present disclosure.

An example of a forging apparatus 100 is shown in FIG. 1. The forging apparatus 100 comprises an upper press 110 and a lower press 120. In operation, the upper press 110 and the lower press 120 move together and are held together by a grip load, which may be on the order of hundreds of tonnes. A die 130 is provided between the upper press 110 and lower press 120. The die 130 comprises a lower die 132 and an upper die 134.

When the upper die 134 and the lower die 132 are brought together (for example by moving the upper press 110 relatively towards the lower press, in the direction of arrow B in FIG. 1), they form two cavities 140, 145 (in FIG. 1, the labels 140, 145 point at the parts of the lower die 132 that would form those cavities when the upper die 134 and the lower die 132 are brought together). The two cavities may be identical, as in the FIG. 1 example. Each cavity 140, 145 comprises a first cavity portion 141, 146 and a second cavity portion 142, 147. Each first cavity portion 141, 146 is arranged (for example sized and/or shaped) to receive a billet of material 150. The billet of material 150 may be extruded in an extrusion operation into a shaped component. The shaped component is formed by forcing the billet 150 from the first cavity portion 141, 146 into the respective second cavity portion 142, 147.

The billet 150 is struck by an extrusion punch 160 in an extrusion operation in order to force (or extrude) the billet 150 from the first cavity portion 141, 146 into the respective second cavity portion 142, 147. The punch 160 may be struck by a ram 190, which may be separate from the punch 160, as in the FIG. 1 example. The punch 160 may be held in a punch holder when it is struck by the ram 190.

The punch 160 comprises a body portion 164 and a striking portion 162. During operation, the punch 160 moves along (for example is driven along) an extrusion path A, so that the striking portion 162 strikes the billet 150. This forces the billet into the second cavity portion 142, 147, and thus the billet 150 deforms to take on the shape of the second cavity portion 142, 147.

Figure 2:
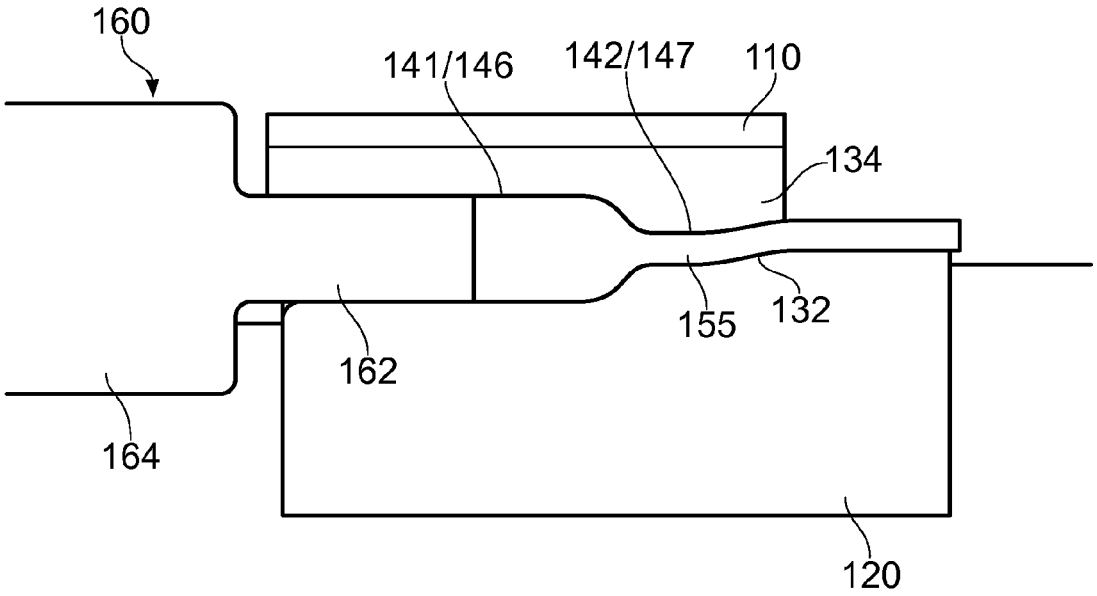
FIG. 2 shows a cross sectional view through a forging apparatus after extrusion of a part.

FIG. 2 shows a cross section through a part of the forging apparatus 100 after extrusion of the original billet 150 has taken place. Accordingly, the original billet 150 has been deformed into the forged part 155, at least a part of which corresponds to a second cavity portion 142/147 of the die 130.

As shown clearly in FIG. 1, the striking portion 162 is offset from the centreline X-X of the body portion 164 of the punch 160. As shown in the FIG. 1 example, the centreline Y-Y of the striking portion 162 may be said to be offset from the centreline X-X of the body portion 164. When in the position shown in the FIG. 1 arrangement, the striking portion 162 is aligned with the first cavity 140, in particular with the first cavity portion 141 of the first cavity 140. Accordingly, when the extrusion punch 160 is driven in the extrusion direction A, the striking portion 162 strikes the billet 150 that is placed in the first cavity portion 141 of the first cavity 140.

The extrusion process described above may be repeated a number of times, with the extruded part 155 being replaced by a new billet 150 after each extrusion (for example either manually or in an automated process, which may involve a robot), the new billet being placed in the same first cavity portion 141 each time. In this way, multiple extruded parts 155 may be formed in the first cavity 140 of the die 130.

Each forging operation causes wear of the cavity 140. After sufficient forging operations have been performed, the cavity 140 used for the forging operations becomes worn to such an extent that the forged parts 155 are no longer within an acceptable tolerance. However, if all of the forging operations have been performed using a first cavity 140 of the two cavities 140, 145 of the die 130, then the other (second) cavity 145 will remain unworn. Accordingly, the second cavity 145 can be used to perform further forging operations without the need to replace the die 130.

Figure 3:
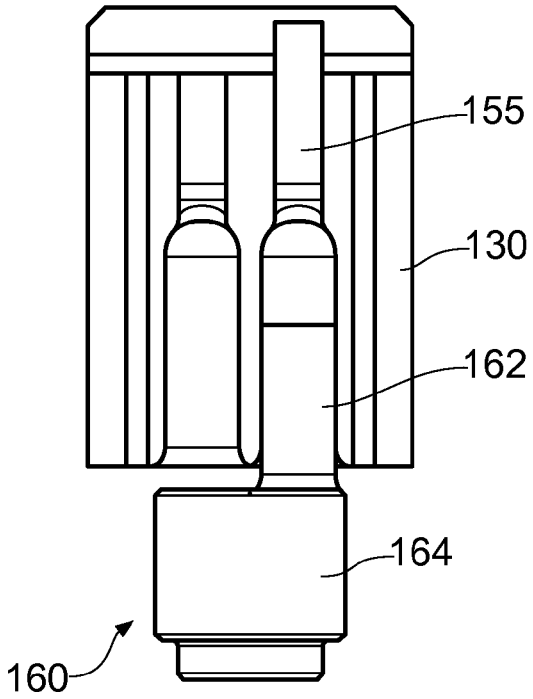
FIG. 3 shows a top view of an extrusion punch extending into a first cavity portion of a first cavity in accordance with an example of the present disclosure.
Figure 4:
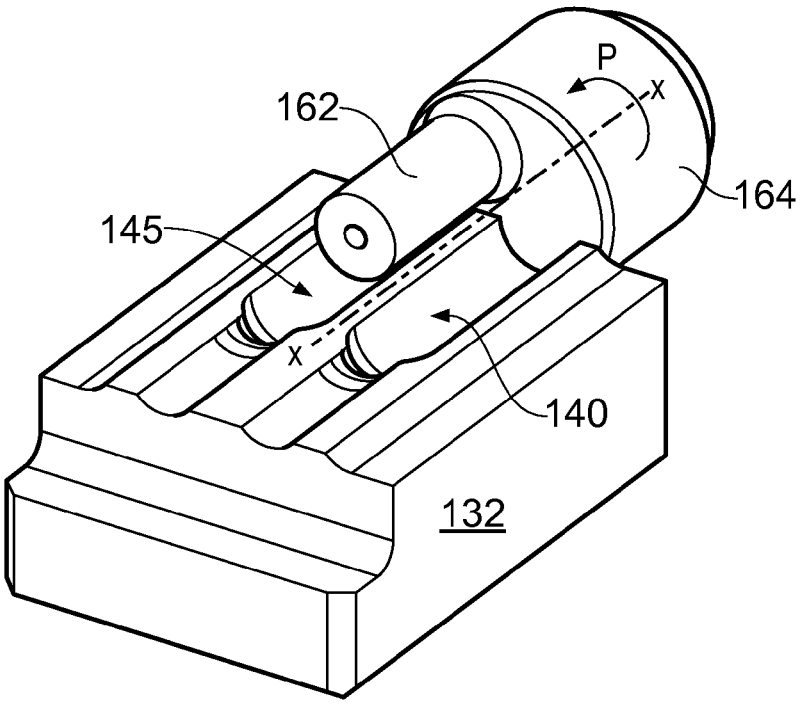
FIG. 4 shows a perspective view of an extrusion punch extending into a first cavity portion of a first cavity in accordance with an example of the present disclosure.
Figure 5:
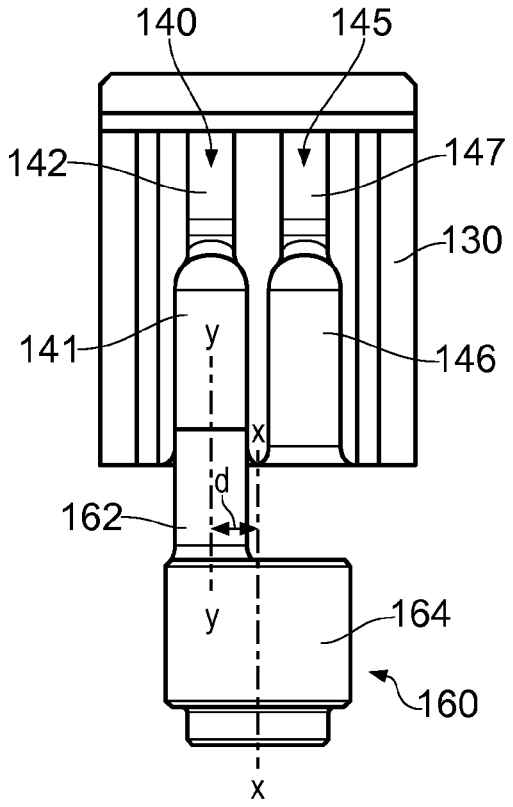
FIG. 5 shows a top view of an extrusion punch aligned with a first cavity portion of a second cavity in accordance with an example of the present disclosure.
Figure 6:
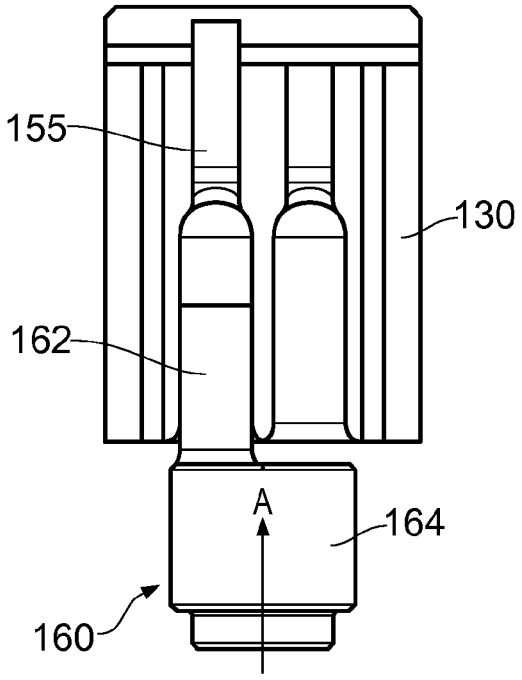
FIG. 6 shows a top view of the extrusion punch of FIG. 5 extending into a first cavity portion of a second cavity after extrusion of a work piece, in accordance with an example of the present disclosure.

FIGS. 3 to 6 are schematics showing the striking portion 162 being aligned with the first cavity 140 (FIGS. 5 and 6) and with the second cavity 145 (FIGS. 3 and 4). The extrusion punch 160 of FIG. 5 is shown in a position in which extrusion of the billet 150 would not have been completed. As the extrusion punch 160 is moved from the position shown in FIG. 5 along the extrusion direction A to the position shown in FIG. 6, the billet 150 is extruded from the first cavity portion 141 to the second cavity portion 142 so as to become the extruded part 155.

In order to extrude billets 150 placed in the second cavity 145, the extrusion punch 160 may be rotated about its longitudinal axis X-X, in the direction indicated by arrow p in FIG. 4. This direction p may be about an axis that is parallel to the extrusion direction. As explained above and elsewhere herein, it may be desirable to do this if, for example, the first cavity 140 is excessively worn, such that the forged parts 155 may no longer be within a suitable tolerance. The rotation of the extrusion punch 160 may be through any suitable angle, such as 180 degrees, as in the example shown in FIGS. 3 to 6. Note that FIG. 3 is the same as FIG. 6, except in that it shows the striking portion 162 being aligned with the second cavity 145, and thus the extruded part 155 being formed in the second cavity portion 147 of the second cavity 145, rather than the second cavity portion 142 of the first cavity 140.

In the example of FIGS. 3 to 6, the longitudinal axis Y-Y of the striking portion 162 is offset from the longitudinal axis X-X of the body portion 164 by a distance d (see FIG. 5), such that the striking portion does not overlap with the longitudinal axis X-X of the body portion. This may allow the striking portion to be aligned with the two separate cavities 140, 145 through rotation about the longitudinal axis (or centreline) X-X of the body portion 164.

Figure 7:
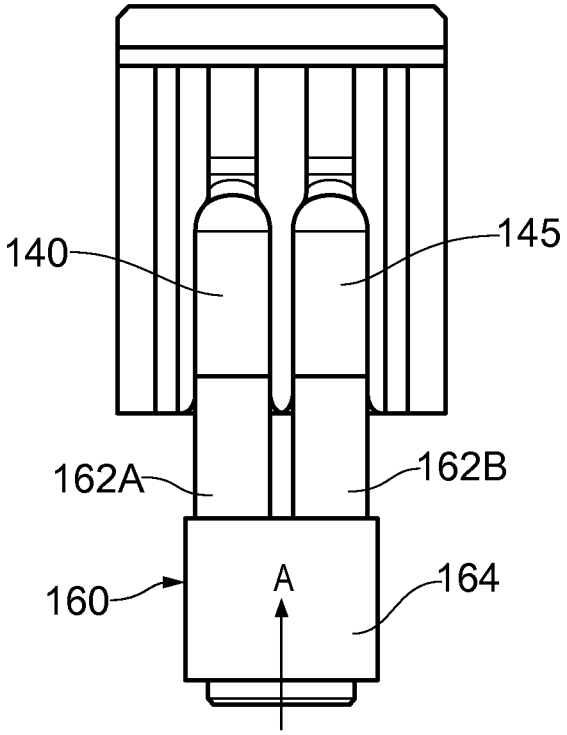
FIG. 7 shows an example of an extrusion punch having two striking portions.

The extrusion punch 160 may comprise one or more than one striking portion 162. FIG. 7 shows an arrangement in which the extrusion punch 160 comprises two striking portions 162A, 162B. One striking portion 162A is aligned with the first cavity 140, and the other striking portion 162B is aligned with the second cavity 145. Accordingly, when the extrusion punch 160 is driven in the extrusion direction A, billets 150 in both the first cavity 140 and the second cavity 145 can be extruded at the same time: one by the first striking portion 162A and one by the second striking portion 162B. This may allow a high throughput of extruded parts 155 to be achieved.

In any example described and/or claimed herein, the extruded parts 155 may be for forming part of a gas turbine engine, for example including aerofoil shapes that may form part of a blade or vane of a gas turbine engine.

As mentioned above, the ram 190 and the extrusion punch 160 may be separate components, as in the FIG. 1 example. Such an arrangement may help to prevent damage to the components of the forging apparatus 100 because no unknown or unwanted force or bending moment is passed through the interface between the relatively narrow extrusion portion 162 of the punch 160 and the rest of the punch 160. Any unwanted force or bending moment that results from an unwanted offset of the ram 190, punch 160 and/or billet 150 passes through the much bulkier and stronger parts of the ram 190 and punch 160 which are not subject to the same dimensional constraints, and thus can be engineered to resist such unwanted forces/bending moments.

Also as mentioned elsewhere herein, the punch 160 may be held in the forging apparatus 100, for example in the lower press 120, by a punch holder (not shown). Such a punch holder may be integral with another part of the forging apparatus (such as the lower press 120), or may be provided as a separate part. The punch holder may restrain (or prevent) the punch 160 from moving in a certain direction, for example in the direction B shown in FIG. 1 in which the upper press 110 is separated from the lower press 120 are moveable relative to each other.

If the extrusion punch 160 and the billet 150 are both placed and held between the upper press 110 and the lower press 120 during forging their relative position, or at least the relative position of their longitudinal axes, is defined by the same piece of apparatus (i.e. the presses 110, 120), and thus cannot vary between forging operations. This arrangement ensures that the punch 160 always strikes the billet 150 in the same direction and at the same position. As such, regardless of any variability in alignment of the punch 160 and the ram 190 (and thus of the billet 150 and the ram 190) no unknown or variable force or bending moment is passed into the punch 160, and so it is not susceptible to breakage.

This means that even if the precise position of upper and lower presses 110, 120 varies slightly between forging operations and/or over time, for example due to the extremely high loads involved, the punch 160, and thus the portion 162 of the punch 160 that strikes the billet 150, is always axially aligned with the billet 150. Thus, even if the ram 190 strikes the punch 160 along a skewed or offset path, the punch 160 still provides a forging (or extrusion) force to the billet 150 that is aligned with the billet 150, for example collinear with the longitudinal axis of the billet 150.

Whilst the example of FIG. 1 is shown as having a separate ram 190 and extrusion punch 160, it will be appreciated that other examples may have a combined ram and punch. For example, the billet 150 may be directly struck by an extrusion punch that is propelled by a motive force (for example an external motive force) towards the billet 150 in the extrusion direction A to form the shaped component 155. As such, an extrusion punch may itself be propelled towards the billet 150 in use, or a separate ram 190 may be provided to strike the extrusion punch.

It will be appreciated that the forging apparatus 100 described and/or claimed herein may be a part of a larger apparatus and/or process. For example, the shaped component 155 generated after the billet 150 has been forged by being forced into a second cavity portion 142, 147 may require further processing, such as finishing and/or further shaping in order to become a finished part. By way of further example, the billet 150 may be heated before being transferred to a first cavity portion 141, 146. The various processes may be automated, including the transportation of the billet 150 and/or shaped components between the various processes.

Any component and/or feature described herein may be combined with any other compatible component and/or feature. Furthermore, it will be appreciated that various alternative and/or complimentary arrangements and/or components not explicitly described herein are in accordance with the disclosure.

I claim:

1. A forging apparatus comprising:

a die for receiving a billet; and an extrusion punch for striking the billet when the billet is in the die, wherein:

the die comprises an upper die and a lower die that together form two cavities;

each cavity comprises a first cavity portion in which the billet is received and a second cavity portion into which the billet is deformed when it is struck by the extrusion punch;

the two cavities are identical, with the first cavity portion of one cavity being identical to the first cavity portion of the other cavity, and the second cavity portion of one cavity being identical to the second cavity portion of the other cavity; and either:

(i) the extrusion punch comprises a body portion and a striking portion, each of which has a longitudinal axis and the longitudinal axis of the striking portion is parallel to and offset from the longitudinal axis of the body portion, the striking portion being received by one of the first cavity portions in order to strike the billet; or (ii) the extrusion punch comprises a body portion and two striking portions, each of the body portion and the two striking portions having a longitudinal axis and the longitudinal axes of the striking portions are parallel to and offset from the longitudinal axis of the body portion, one of the striking portions being positioned to be received by the first cavity portion of one of the cavities in order to strike a billet and the other of the striking portions being positioned to be received by the first cavity portion of the other cavity in order to strike a billet.

2. The forging apparatus according to claim 1, comprising the extrusion punch of (i).

3. The forging apparatus according to claim 2, wherein the longitudinal axis of the striking portion is offset relative to the longitudinal axis of the body portion such that rotation of the extrusion punch about the longitudinal axis of the body portion by a predetermined angle results in the striking portion moving from a position in which it can be received by the first cavity portion of one cavity to a position in which it can be received by the first cavity portion of another cavity.

4. The forging apparatus according to claim 2, wherein the striking portion and the centreline of the body portion do not overlap.

5. The forging apparatus according to claim 1, comprising the extrusion punch of (ii).

6. The forging apparatus according to claim 1, further comprising a ram arranged to strike the extrusion punch, thereby causing the extrusion punch to strike the billet.

7. A method of extruding a billet into a formed shape comprising:

placing the billet into one of two cavities of a die, each cavity comprising a first cavity portion for billet placement and a second cavity portion; and striking the billet with an extrusion punch so as to push and deform the billet from the first cavity portion into the respective second cavity portion, wherein:

the two cavities are identical, with the first cavity portion of one cavity being identical to the first cavity portion of the other cavity, and the second cavity portion of one cavity being identical to the second cavity portion of the other cavity; and either:

(i) the extrusion punch comprises a body portion and a striking portion, each of which has a longitudinal axis and the longitudinal axis of the striking portion is parallel to and offset from the longitudinal axis of the body portion, the striking portion being received by one of the first cavity portions in order to strike the billet; or (ii) the extrusion punch comprises a body portion and two striking portions, each of the body portion and the two striking portions having a longitudinal axis and the longitudinal axes of the striking portions are parallel to and offset from the longitudinal axis of the body portion, one of the striking portions being positioned to be received by the first cavity portion of one of the cavities in order to strike the billet and the other of the striking portions being positioned to be received by the first cavity portion of the other cavity in order to strike another billet.

8. A method of extruding one or more billets, comprising extruding each billet according to the method of claim 7, wherein:

the die comprises an upper die and a lower die; and the upper die and the lower die are moved together in order to form the first and second cavities.

9. A method of extruding multiple billets into formed shapes comprising:

extruding at least one billet by placing the billet into one of two cavities of a die, each cavity comprising a first cavity portion for billet placement and a second cavity portion, and striking the billet with an extrusion punch so as to push and deform the billet from the first cavity portion into the second cavity portion of the first cavity, the extrusion punch comprising a body portion and a striking portion, the striking portion being used to strike the billet;

moving the extrusion punch so as to move the striking portion to be aligned with the second cavity rather than the first cavity; and extruding at least one other billet by placing the other billet into the second cavity of the die and striking the other billet with the extrusion punch so as to push and deform the other billet from the first cavity portion into the second cavity portion of the second cavity.

10. The method of extruding multiple billets according to claim 9, wherein:

each of the body portion and the striking portion of the extrusion punch has a longitudinal axis, the longitudinal axis of the striking portion being parallel to and offset from the longitudinal axis of the body portion; and the step of moving the extrusion punch comprises rotating the extrusion punch about the longitudinal axis of the body portion.

11. The method of extruding multiple billets according to claim 10, wherein the rotation of the extrusion punch about the longitudinal axis of the body portion is through 180 degrees.

12. The method of extruding multiple billets according to claim 9, wherein the step of moving the extrusion punch is performed when the first cavity is deemed to be worn sufficiently that the formed shapes would not be within design tolerance.

13. The method of extruding multiple billets according to claim 9, comprising a step of monitoring wear of the first cavity so as to determine when to move the extrusion punch.

14. The method of extruding multiple billets according to claim 9, wherein the two cavities are identical, with the first cavity portion of the first cavity being identical to the first cavity portion of the second cavity, and the second cavity portion of the first cavity being identical to the second cavity portion of the second cavity.

15. A forging apparatus comprising:

a die for receiving a billet; and an extrusion punch for striking the billet when the billet is in the die, wherein:

the die comprises an upper die and a lower die that together form two cavities;

each cavity comprises a first cavity portion in which the billet is received and a second cavity portion into which the billet is deformed when it is struck by the extrusion punch;

the extrusion punch comprises a body portion and a striking portion, each of which has a longitudinal axis and the longitudinal axis of the striking portion is parallel to and offset from the longitudinal axis of the body portion, the striking portion being received by one of the first cavity portions in order to strike the billet; and the longitudinal axis of the striking portion is offset relative to the longitudinal axis of the body portion such that rotation of the extrusion punch about the longitudinal axis of the body portion by a predetermined angle results in the striking portion moving from a position in which it can be received by the first cavity portion of one cavity to a position in which it can be received by the first cavity portion of another cavity.

* * * * *